US007195565B2

(12) United States Patent
White et al.

(10) Patent No.: US 7,195,565 B2
(45) Date of Patent: Mar. 27, 2007

(54) GOLF CLUB FITTING SYSTEM

(76) Inventors: James White, 1800 Wilderness Woods Pl., Lincoln, NE (US) 68512; Greg Johannesen, 1800 Wilderness Woods Pl., Lincoln, NE (US) 68512

( * ) Notice: Subject to any disclaimer, the term of this patent is extended or adjusted under 35 U.S.C. 154(b) by 0 days.

(21) Appl. No.: 10/761,668

(22) Filed: Jan. 21, 2004

(65) Prior Publication Data

US 2004/0204262 A1 Oct. 14, 2004

Related U.S. Application Data

(60) Provisional application No. 60/441,549, filed on Jan. 21, 2003.

(51) Int. Cl.
*A63B 53/00* (2006.01)

(52) U.S. Cl. ..... 473/296; 473/297; 473/409; 473/337; 73/379.02

(58) Field of Classification Search ..... 473/287–291, 473/409, 296–297, 337; 73/379.02, 379.03
See application file for complete search history.

(56) References Cited

U.S. PATENT DOCUMENTS 5,681,993 A * 10/1997 Heitman ..... 73/379.02
6,106,411 A * 8/2000 Edwards ..... 473/292
6,328,660 B1 * 12/2001 Bunn, III ..... 473/257

* cited by examiner

*Primary Examiner*—Stephen Blau
(74) *Attorney, Agent, or Firm*—Adam H. Jacobs

(57) ABSTRACT

An improved golf club fitting system for fitting a set of golf clubs to a player includes the steps of measuring a player's hand grip strength and selecting a representative golf club having a dead weight directly proportional to the player's grip strength. The club length and the swing weight of the representative golf club are then determined by standard testing procedures commonly used in the golf club industry. A balance index (BI) for the representative golf club is then computed by dividing the dead weight (DW) by the swing weight (SW) (DW/SW=BI) and the balance index (BI) is compared to the dead weight to determine generally corresponding values for the remaining other golf clubs in the set such that the system user can match different irons and woods to the representative golf club thereby creating an ideal matched set of golf clubs for the player.

10 Claims, 5 Drawing Sheets

GOLF CLUB FITTING SYSTEM

CROSS-REFERENCE TO RELATED PROVISIONAL APPLICATION

This application claims priority to the filing date of related provisional patent application Ser. No. 60/441,549 filed Jan. 21, 2003.

BACKGROUND OF THE INVENTION

1. Technical Field

The present invention relates to systems for custom fitting of golf clubs to players and, more particularly, to a golf club fitting system in which club deadweight and balance are matched to each player's physical strength level, flexibility, and swing type, the clubs within the player's set are weight and balance matched for more consistent on-course performance, the ability to perform test hitting on an adjustable lie-board which is adjusted to the playing position of the desired fitting club thus eliminating the use of innumerable test clubs with different lie angles and enabling determination of exact lie angle specifications and that the test clubs used in connection with the system of the present invention are adjustable both in length and head weight to determine the unique and correct fitting specifications for each user of the system.

2. Description of the Prior Art

The golf equipment industry continues to make quantum leaps in club design and construction materials, with millions upon millions of dollars being poured into advertising of the new technology and further research and development to come up with even more technological advances, all to try to gain an edge in the highly competitive marketplace. While companies have adopted a wide variety of design and performance concepts, one area which has become of primary importance is effective club fitting and the improvement of custom club building capabilities. However, the advances in club design have not been matched by similar advances in club fitting, particularly in the areas of comprehensive information, economics and simplicity of the fitting process. There is therefore a need for a club fitting system which is efficient, accurate and cost-effective to permit the widest use of the system.

Even though there are numerous configurations of fitting systems in use today, there are several very important issues which remain unaddressed and unsolved. While most reputable club fitting systems address the more common fitting specifications in some fashion or another, including shaft flex, shaft length, grip size, lie angle and loft, there is no single system which addresses these specifications and also addresses club weight and club balance as they relate to player physical strength and swing types to prepare a truly matched set of clubs for each player. There is therefore a need for a golf club fitting system which will address many different significant specifications during the fitting process, yet will do so in a relatively simple and straightforward manner to permit use of the system by fitters with only a moderate amount of training.

Therefore, an object of the present invention is to provide an improved golf club fitting system.

Another object of the present invention is to provide an improved golf club fitting system in which the player's grip strength is tested to determine the proper dead weight of the golf club to be used, the selected golf club is measured to determine the swing weight of the selected golf club, the balance index is determined by dividing the dead weight by the swing weight, and the proper club set selection is determined by graphing the balance index versus the dead weight to find each club for use by the player.

Another object of the present invention is to provide an improved golf club fitting system which includes an adjustable lie board and the use of marking tape on the club head which will determine the proper fitting of the test club and moreover, that the use of the adjustable lie board will permit the use of a single test club during the fitting process, with angle changes being made via the adjustable lie board instead of through the use of multiple test clubs with slightly different club head angles.

Another object of the present invention is to provide an improved golf club fitting system which includes significant player interviews for gathering of information regarding preferred clubs, playing capabilities and strengths and weaknesses in order to permit the user of the present invention to make minor adjustments to the specific club set dictated by the numbers set forth by use of the present fitting system.

Another object of the present invention is to provide an improved golf club fitting system which is usable with only a small amount of training so that the proper use of the system is generally guaranteed regardless of the experience of the user.

Finally, an object of the present invention is to provide an improved golf club fitting system which is relatively simple and inexpensive to manufacture and is intuitive, safe, effective, and accurate in use.

SUMMARY OF THE INVENTION

The present invention provides an improved golf club fitting system for fitting a set of golf clubs to a player including the steps of measuring a player's physical dimensions at least including grip strength of the player's hand and selecting a representative golf club having a specific dead weight based on the measured grip strength of the player's hand, the dead weight being directly proportional to the player's grip strength, specifically that the dead weight of the golf club is greater when the player's grip strength is greater and vice versa. The club length of the representative golf club is then recorded and the swing weight of the representative golf club is determined, and from these numbers, a balance index (BI) for the representative golf club is computed by dividing the dead weight (DW) by the numerical value of the swing weight (SW) (DW/SW=BI). This balance index (BI) is determined for the representative golf club to further determine alternatively the head heavy and head light deviation for the representative golf club. Finally, the balance index and dead weight values determined for the representative golf club are generally corresponded to at least some of the other golf clubs in a set of golf clubs such that the system user can generally match different iron and wood golf clubs to the representative golf club thereby creating a generally ideal matched set of golf clubs for the player.

It is clear that the features of this invention combine to form an easily useable and accurate improved golf club fitting system for use with players of virtually any skill and experience level. For example, a user of the present invention can quickly and easily learn the basic fitting elements of the system, thus helping to prevent improper usage of the system due to inadequate training. Furthermore, the test golf club provides numerous advantages over other such test golf clubs, as the length and weight of the club can be quickly and easily adjusted to obtain the preferred length and weight for the player without requiring use of multiple test clubs, which can severely degrade the accuracy of the fitting process. Also, the Balance Index is heretofore unknown in the prior art yet it has been found that the swing weight divided by the dead weight of the club provides an extremely useful baseline measurement, one on which, in fact, the specifications for the entire club set can be based. Finally, the adjustable lie board allows the fitter and the player to effectively change the angle of the ground off which the player is hitting, thus eliminating the need for the player to use multiple test clubs during the fitting process and enabling far more accurate measurements to be made during the process. It is thus seen that the present invention provides a substantial improvement over those fitting systems found in the prior art.

DESCRIPTION OF THE PREFERRED EMBODIMENT

Figure 1:
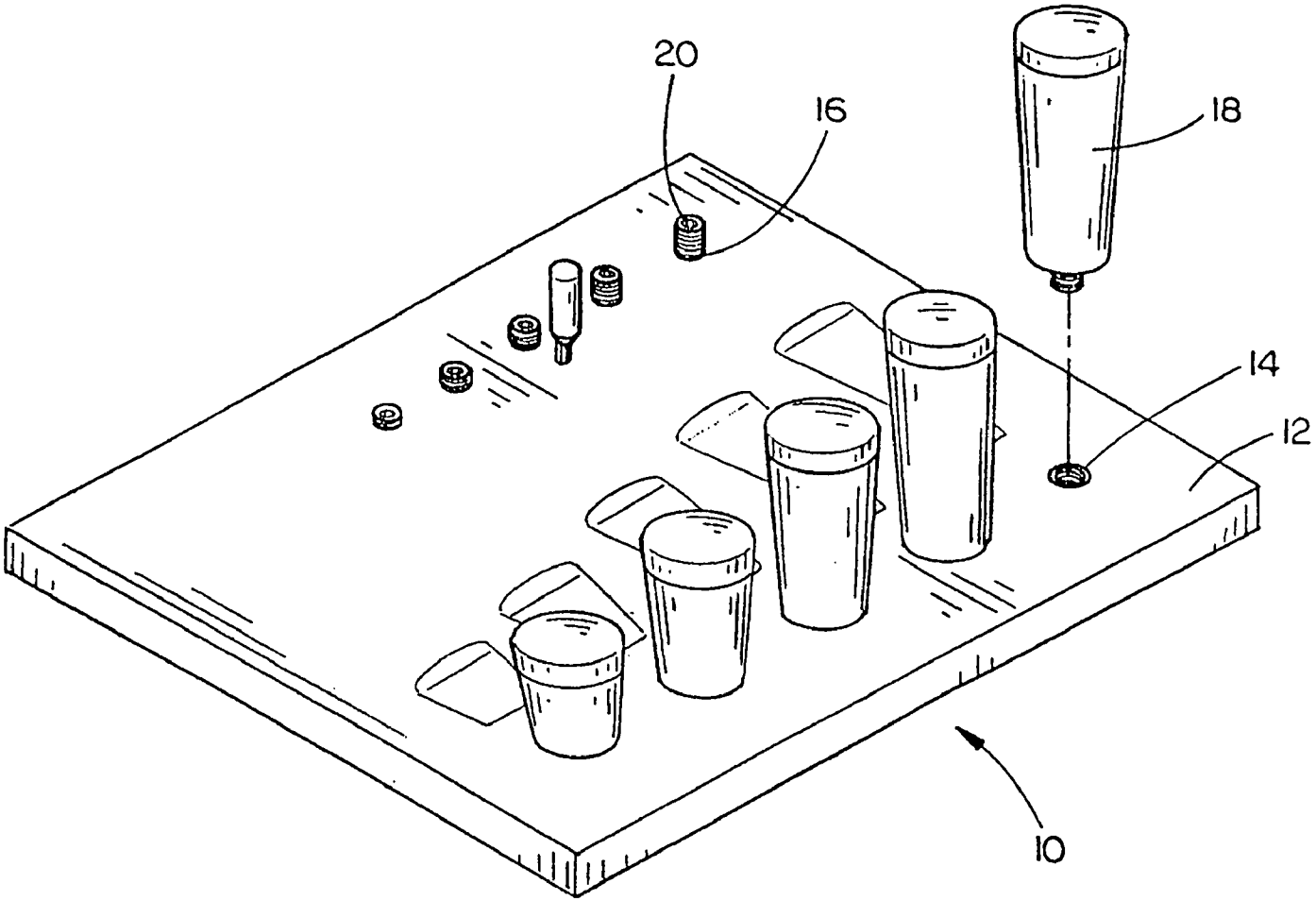
FIG. 1 is a perspective view of the club head weights and shaft length extension display plate to be used.

The golf club fitting system of the present invention is designed to provide a relatively easy to use fitting system which is powerful in its informational and accuracy capabilities. The preferred method of the present invention is intended to accomplish the proper fitting of clubs to player through the use of four key elements. These are as follow:

1. Club deadweight and balance are matched to each player's physical strength level, flexibility, and swing type;
2. The clubs within the player's set are weight and balance matched for more consistent on-course performance;
3. The capability to perform test hitting on an adjustable lie-board which is adjusted to the playing position of the desired fitting club thus eliminating the use of innumerable test clubs with different lie angles and enabling determination of exact lie angle specifications; and
4. The test clubs used in connection with the system of the present invention are adjustable both in length and head weight to determine the unique and correct fitting specifications for each user of the system.

To utilize and achieve these elements, the golf club fitting system of the present invention contemplates the following preferred step-by-step procedure for fitting, variations of which will be discussed following this description of the procedure.

Golf Club Fitting System of the Present Invention

Step I—Collection of Personal Information

A. Communication with the Player
- Get the player relaxed, yet excited about the fit. Briefly explain the process and equipment used.

B. Player Profile (Collection of Information)
- Physical limitations.
- Right/left hand player?
- Current playing ability.
- Participation: Current playing and practice time.
- Player's interpretation of their game.
  - Strong points.
  - Weak points.
  - Confidence level.
- Current shot tendencies.
- Player's goals for their game and the fitting session.

C. Current Equipment
- Irons.
- Woods.
- Custom fit?
- Player's likes/dislikes on club aesthetics and feel.
- Record specifications on selected clubs and favorites.
- Club length, shaft frequency and corresponding flex on the appropriate CPM chart.
- Record dead weight (in ounces), swing weight (numeric value), and balance index, computed by the following formula, dead weight divided by swing weight=balance index (DW/SW=BI).

Step II—The Warm-up

A. Flexibility Test
- Use appropriate tests and assess potential problem areas.
- Record results as one of the following: N (no adj. needed), or ± (excessive), or − (limited) adjustment factor for the final grip strength value.
- Discuss any concerns and recommendations with the player.

B. Stretching Out and Getting Focused
- Get the player adequately loosened up before recording any hitting information.
- Get the player comfortable with the presence of the fitting equipment.

C. Initial Hitting
- Use the player's own club first.
  - Use 6-iron for men.
  - Can use a 7 or 8-iron for women and refer to 6-iron on dead weight fitting chart 1-C.
  - Then go to the player's own driving club if fitting woods.
- After warm-up, have the player hit three (3) representative shots.
  - Record carry distance and club head speed for selected shots (successful) using the Distance Caddy. Observe ball flight tendencies.
- Observe ball flight tendencies and begin swing analysis.
  - Present posture and balance characteristics.
    - Assess needed changes.
    - Consider effect on results during the fit.
    - Check gripping habits at top of grip as initial indicator on shaft length needs.
    - Effect on player's balance.
    - Effect on club length recommendation.
  - Record any swing tempo and shaft loading adjustments needed: N, or ± or −.
    - Quick pace=lighter dead weight (−)
    - Heavy loading=less dead weight (±)
  - Swing speed and shaft flex.
    - Obtain average swing speed for 6-iron and/or driver.
    - Record preliminary shaft flex from chart #2.

Step III—Static Measurements

A. Grip Strength Test with the Dynometer
- Set tester for player's hand-size.
- Player holds tester with arm in handshake position.
- Take test with each hand, record and average.
- Consider flexibility, swing tempo and shaft loading adjustments and record final average.

B. Grip Size
- Measure middle finger length.
- Measure palm to wrist-crease length.
- Evaluate grip type, whether palm or finger dominant.
- Refer to chart #3 for recommendation.
- Give consideration to current grip size and effects if changed.

C. Club Shaft Length
- Record the player's height.
- Record ground-to-palm/knuckle of longest finger for both sides with the player standing tall with shoulders relaxed, down and level and arms hanging down at sides.
- Average the two measurements (L-S).
- With the player in address position with current 6-iron, measure ground to middle finger palm/knuckle on the target side of player to determine drop (L-A).
- Record preliminary length from chart #4, but also include the following considerations:
  - Any posture changes needed;
  - Current playing ability;
  - Player's flexibility, body-size and age.

D. Club Deadweight and Balance
- Refer to chart #1-A for initial 6-iron deadweight and balance figures and record as preliminary. (Use proper club length line.)
- Refer to chart #1-B for driver reference.
- To calculate swing weight from chart #1: Use dead weight divided by the balance index.
- To calculate dead weight for club: Use swing weight (numeric) multiplied by the balance index.

Step IV—Test Club Configuration

A. Select Proper Club Dead Weight
- Consider head weights available in the desired styles.
- Determine best club head/shaft configuration considering:
  - Recommended shaft length from fitting chart #4.
  - Shaft material options available.
  - Needed adjustments due to flexibility, swing tempo, and shaft loading effects, all previously recorded.
  - Consider any potential additional grip weight due to size recommendations.

B. Calculate Best Club Balance and Adjust Head Weight of Test Club:
- Consider above parameters and effects on preliminary balance recommendations.
- Assess amount of change in balance needed from present clubs.
- Factor in present ball flight tendencies and effects of head-light vs. head-heavy balance (draw/fade).

C. Determine Best Shaft Flex and Torque Characteristics Factoring in:
- Swing speed test results.
- Transition tempo and shaft loading.
- Recommended playing length and effect on final flex.
- Shot trajectory tendencies.

D. Set the Proper Test Club Length Using the Adjustable Grip Length Extensions Provided on the Display Board as Shown Best in FIGS. 1 and 2.

Step V—Test Club Hitting

A. All Test Hitting Must be Done "Blind" to the Player.

B. Hit 3 Representative Shots with Each of 3–5 Test Clubs with Short Tee. Record the head weight setting with each test club used.
- Record the carry distance and club head speed on selected shots.
- Give primary consideration to the 2nd and 3rd shot with each test club.
  - Observe ball flight and trajectory tendencies.
  - Listen for best sound at impact for proper shaft flex.
  - Ask for player's impressions of each club likes/dislikes and any apparent "feel" differences.

C. Dynamic Lie Angle Test.
- Use proper test club at the recommended length and flex.
- Place tape on club sole and hit 1 to 2 shots off of the adjustable lie board, shown best in FIGS. 3 and 4.
- Note position of impact mark on tape and make the necessary lie board adjustment and repeat this process until the contact mark is centered on the sole in relation to the heel/toe of the club head.

Step VI—Final Analysis

A. Compare Results from Test Clubs Hit, Including Player's Own Club.

B. On a One-shot Basis, Alternate the Best Test Club with Other Clubs in the Player's Set for Compatibility and Consistent Performance.

C. Record Final Fitting Specifications.

D. Determine the Best Club Set Make-up for the Player.

End of System

The golf club fitting system of the present invention makes reference to numerous fitting charts and graphs, each of which are included in the attached "Appendix 'A'". Although the charts are generally self-explanatory, it should be noted that the important steps of plotting the preferred dead weight and swing weight ratio as the balance ratio will determine to a great extent the nature 0f the club set. For example, a player would come in to the fitter and as part of the fitting process, the fitter would ask the player what is his or her current favorite club in their present set, if one exists. Using the player's specific favorite club as a guideline, the club dead weight is divided by the swing weight to get the balance index (DW/SW=BI), which will permit the fitter to calculate the approximate dead weights and swing weights and hence the balance indexes for the remaining clubs in the desired set. The remaining fitting process, though involved and incorporating much information, can be greatly accelerated due to the narrowing of scope of acceptable club choices by evaluating a player's favorite club. Of course, it should be noted that evaluating a player's favorite club is only one element of the system of the present invention, yet one which will provide much assistance in determining the final fitting specifications.

It should be noted that there are at least two methods by which the Balance Index may be selected, with the first being the use of the player's favorite club as was stated above, and with the second being by using the grip strength of the individual golfer as has been described previously and which will be described in greater detail as follows.

A representative golf club is selected through the process explained in step III, part D:

The test club is selected using the final adjusted grip strength reading from earlier grip testing procedure. A test club within the appropriate dead weight range, while at the recommended length, is determined. For example, a golfer is measured and tested, and it is determined that he requires a 6-iron dead weight of 14.8 ounces, at a length of +1" over standard length, by using the grip strength and proceeding directly downward on chart #1A and by measuring the height of the golfer. Further using chart #1A, the Balance Index is determined by plotting a point directly below the 14.8 dead weight figure on the +1" reference line. The corresponding Balance Index (i.e. how the club feels to the player) is read at the horizontal axis at the left border of the chart. The resulting normal swing weight, as represented by the reference line, is determined by dividing the dead weight by the Balance Index: i.e.: 14.8/0.707=20.93. Using the swing weight conversion chart for irons, the lorhythmic swing weight is determined as D 3.6. A test club can now be set up.

The fitting charts can be used to test and/or match other clubs in the set (i.e.: 9-iron, 7-iron, 3-iron, fairway wood, etc.) by simply plotting, on the appropriate length-reference line, the Balance Index for that given club using its dead weight and swing weight values. Within a given set of clubs, the amount of deviation from the appropriate length-reference line on the proper chart, should be consistent. For example, if the 6 iron is +2 units (horizontal lines on the chart) below the reference line (head heavy side), then any other properly matched club in this set will plot the same distance below its reference line, which is the +1" over-length line in the case of these irons.

The Dead Weight chart #1-C is used to determine the proper weight of any club within any given set of clubs. For example, if a player requires a 15.2 ounce 6-iron, his driver should weigh 11.35 ounces, 3 wood 11.85 oz., and so on. Proper final balance is determined through test hitting with varied head weights with the 6-iron test clubs. Accordingly, if the best performing 6-iron's Balance Index is determined to be a +2 (2 units or horizontal lines below the appropriate reference line on the 6-iron fitting chart) at the proper dead weight, then the player's driver should also be a +2 at the appropriate dead weight and length-reference line.

This fitting system can be used with any other club in the set, including the 7-iron, simply by determining the proper dead weight of the player's 6-iron, then using the Dead Weight Chart to determine the proper weight of the selected club. As stated previously, any matched club should have the same Balance Index deviation from its appropriate reference line. The Iron Fitting Chart is labeled 6 Iron Fitting Chart because this chart is also used to match the proper dead weight of the irons, through the six iron, to the player's physical strength, swing motion, etc. The same situation exists with the Driver Fitting Chart, and an appropriate chart may be prepared for each of the clubs in a player's set.

Versatility, affordability, and convenience are all important attributes of the golf club fitting system of the present invention. Further, when these features are combined with the accurate and powerful fitting information obtained for each individual player, the fitting results produced by this system are superior to those found in the prior art and will result in the development of a network of astute club fitters and a multitude of better performing customers.

The golf club fitting system of the present invention was created out of a desire for obtaining improved fitting information to facilitate the process of getting performance-enhancing golf equipment in the hands of players of all skill levels from beginner to professional. Although the fitting system of the present invention was initially designed to focus on a player's set of irons, it has been easily and quickly adapted to use with the fitting of driver and fairway woods thus bringing the fitting system of the present invention to its present form. Further developments contemplated and included as elements of the present invention will include the development of fully adjustable test clubs in drivers, fairway woods, utility clubs (hybrids), wedges, and putters, in addition to the irons currently developed for use with the present invention. These additions increase the versatility of this system and provide the fitter with enhanced ability to accurately match any individual club to the rest of a player's set. This is accomplished through both diagnostic work and the additional important aspect of being able to test hit actual clubs with the desired fitting specifications applied.

Figure 2:
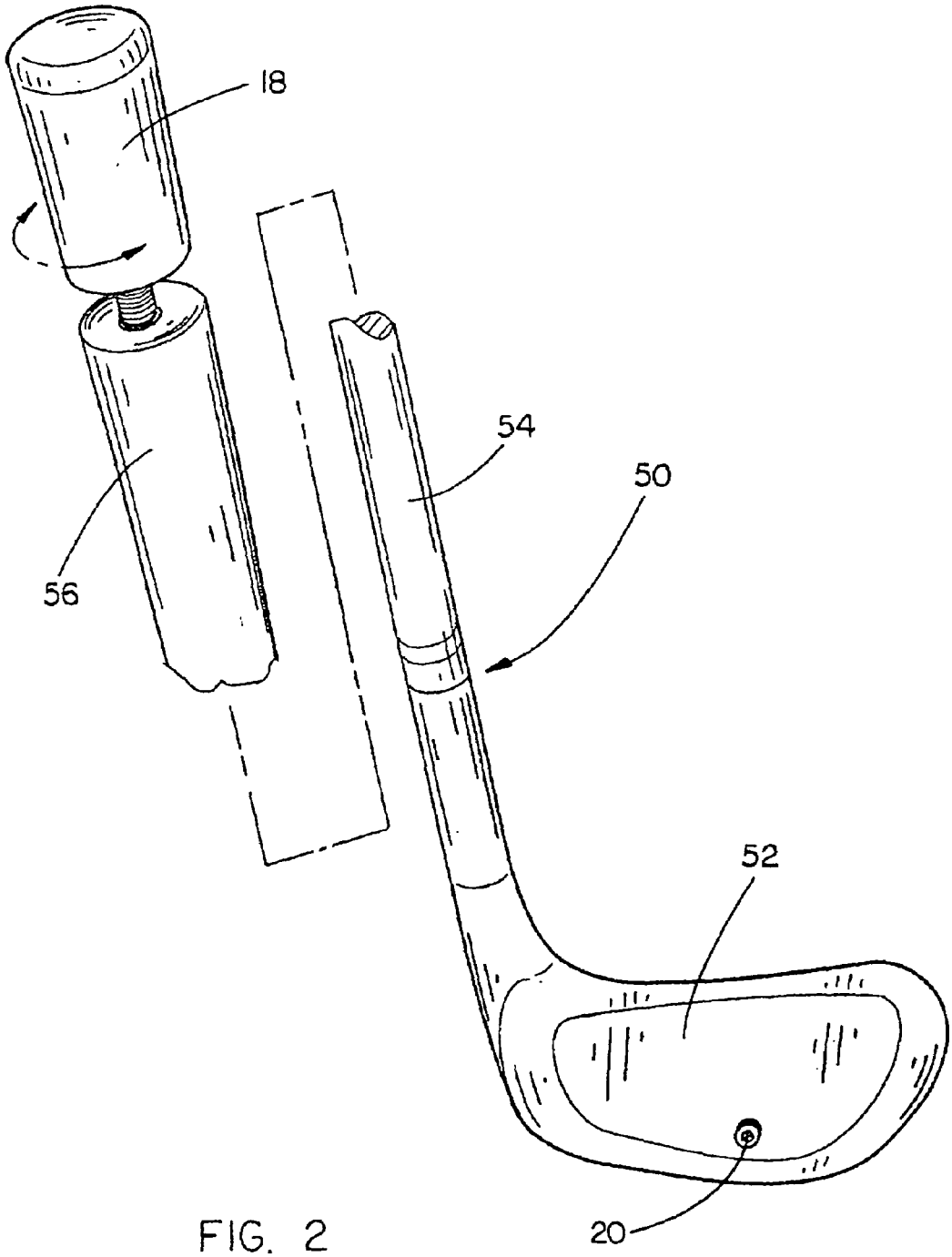
FIG. 2 is perspective view of a test club fitted with the shaft extensions and weights of the display plate.

Additional features of the present invention are shown in FIGS. 1–4, and include the display board 10 of the present invention which is shown best in FIGS. 1 and 2 as including a planar support board 12 which includes a plurality of shaft extension support holes 14 and a plurality of head weight support holes 16 formed therein for supporting and displaying the shaft extensions 18 and head weights 20 respectively. As shown best in FIG. 2, the shaft extensions 18 are designed to screw into the top end of the grip 56 of the test club 50 and the head weights 20 are designed to be screwed into the club head 52 mounted on the shaft 54 of the test club 50. In the preferred embodiment, the shaft extensions 18 would be made in a series of progressively lengthened units, i.e. the one-inch extension, the one and one-half inch extension, etc. Likewise, the head weights would be made in progressively heavier units, i.e. the ¼ ounce weight, the ½ ounce weight, etc. In this manner, the precise weight and shaft length for the test club 50 can be set so that the player and fitter can determine the best fitting club for the player and use the resulting figures to fit the rest of the desired set.

Figure 3:
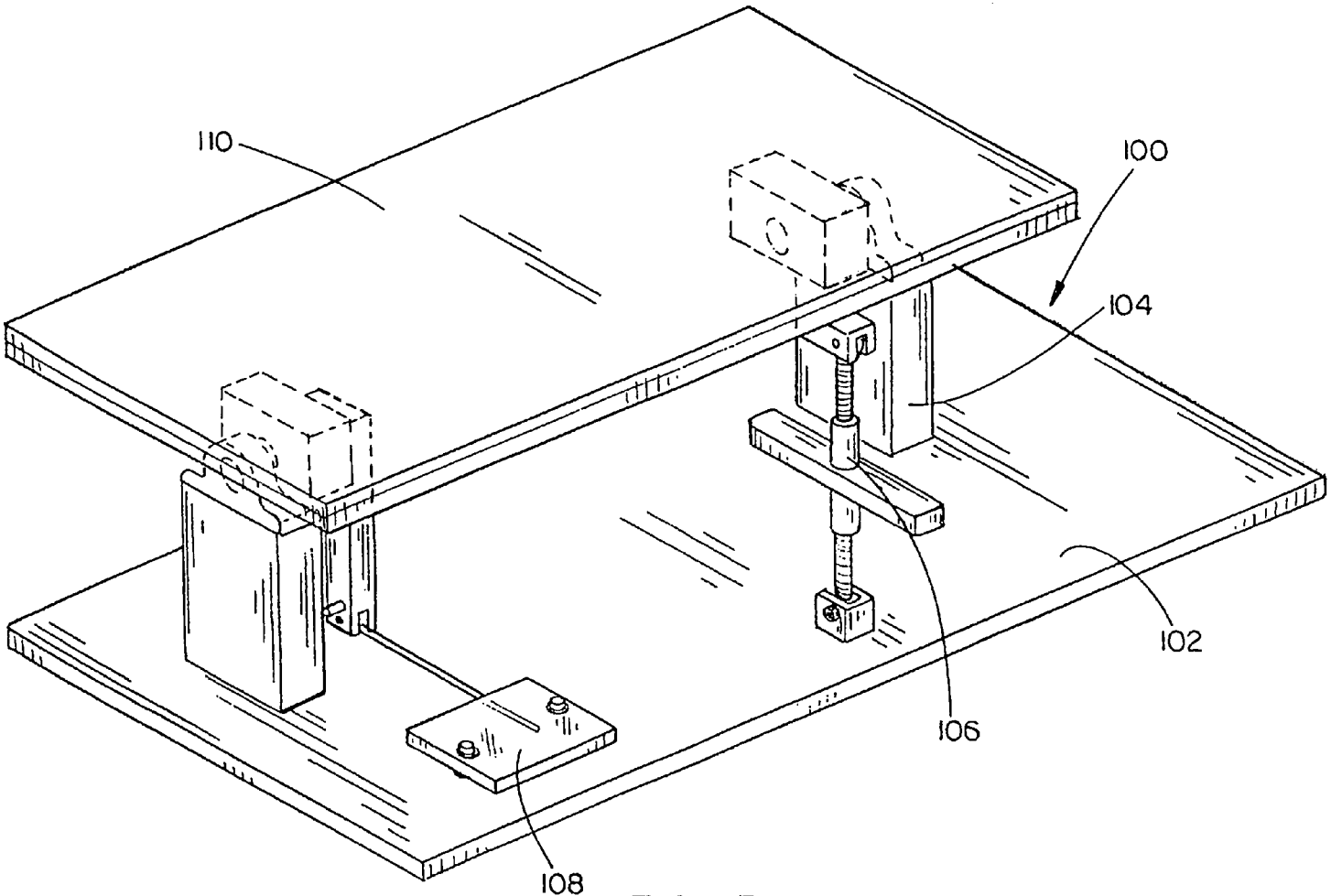
FIG. 3 is a perspective view of the adjustable lie board to be used with the present invention.
Figure 4:
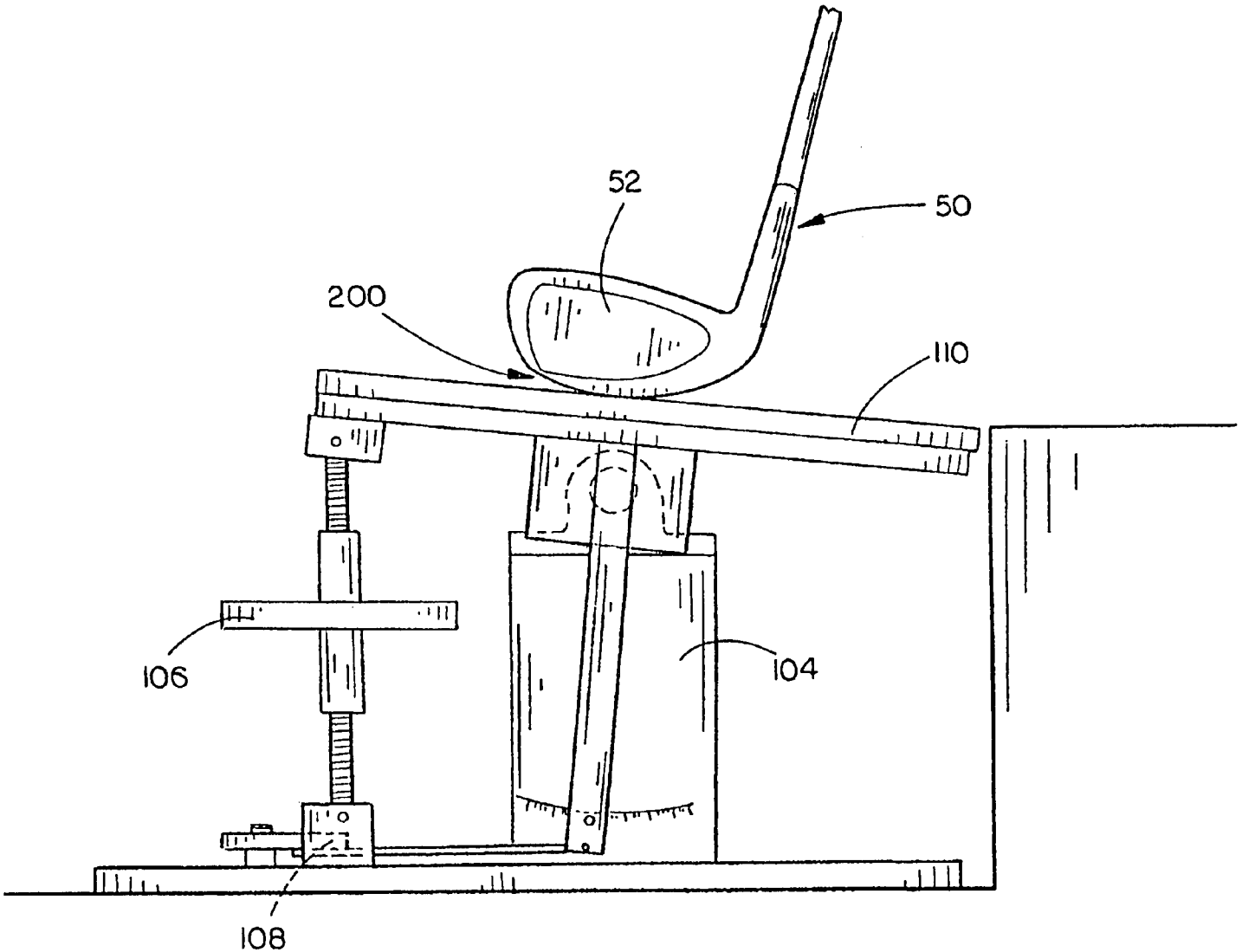
FIG. 4 is an end elevational view of the adjustable lie board being used to fit a club thereon.
Figure 5:
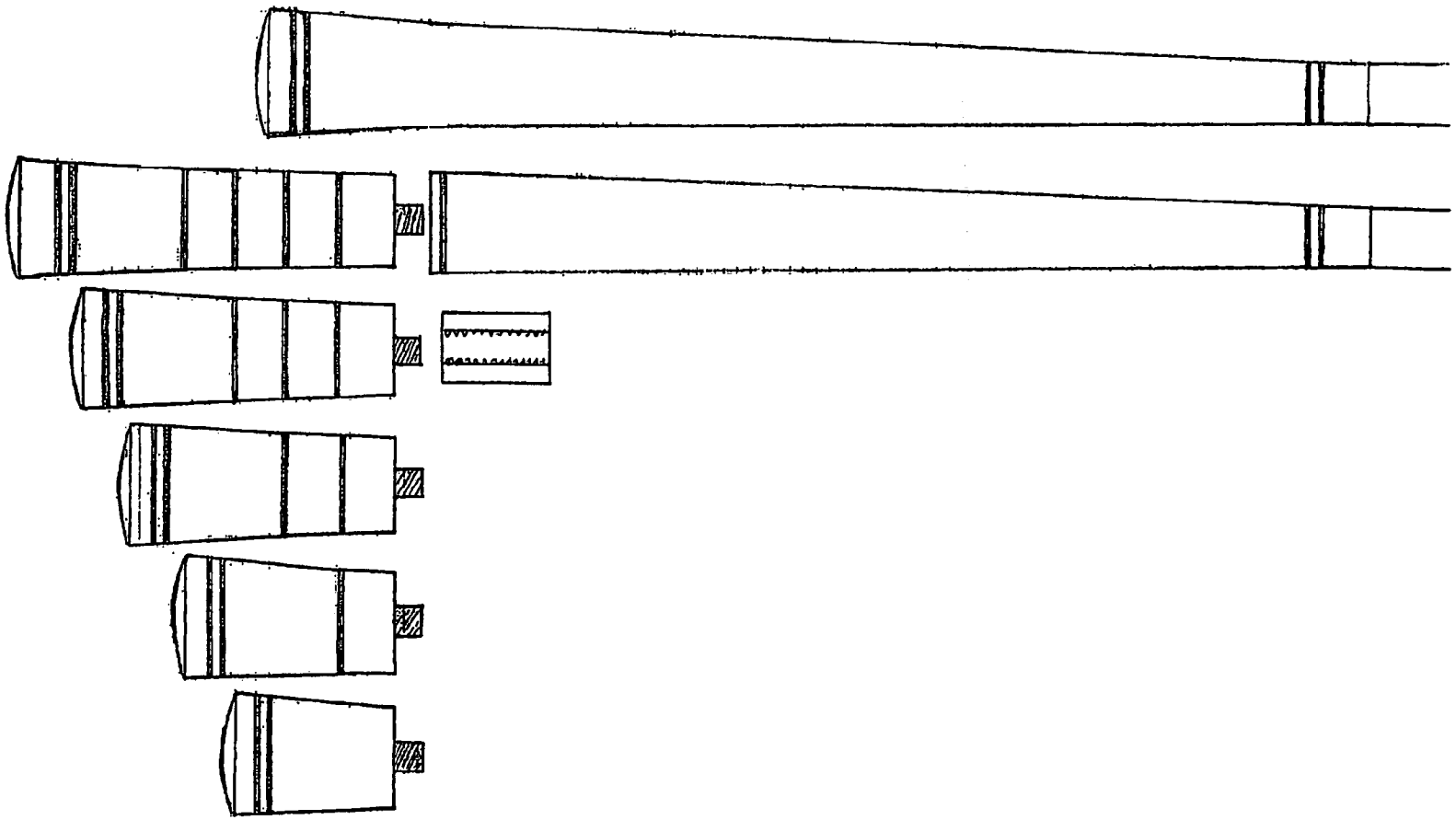
FIG. 5 is a side elevational view of the adjustable length fitting club showing the shaft extensions usable therewith which is used in connection with the method of the present invention; and Appendix "A" includes representative charts used with the golf club fitting system of the present invention.

The adjustable lie board 100 of the present invention is shown best in FIGS. 3 and 4 as including a base plate 102 on which is mounted a lie plate stand 104 which in the preferred embodiment would be a pair of upright support columns. Pivotably mounted on the lie plate stand 104 is the lie plate 110, which, in the preferred embodiment, would be a metal plate which pivots along a generally horizontal line in a "see-saw" motion. The pivoting of the lie plate 110 is controlled by a threaded screw 106 which extends or retracts depending on the rotation of the screw 106 thus raising or lowering one side of the lie plate 110 and thus changing the angle of the lie plate 110 relative to the base plate 102. The angle readout device 108 permits quick and accurate reading of the angle of the lie plate 110 which will assist the fitter in the setting of the club head 52 to the correct angle relative to the club shaft 50 for the player's swing. The use of tape 200 on the club head 52 will determine the proper fitting of the test club 50 and moreover, the use of the adjustable lie board 100 permits the use of a single test club 50 during the fitting process, with angle changes being made via the adjustable lie board 100 instead of through the use of multiple test clubs with slightly different club head angles. The present invention thus provides even further streamlining of the fitting process and a further improvement over the prior art fitting systems.

Two other areas in this fitting system are also in the development stage at this time, yet are contemplated as elements of the present invention and disclosure. One, the grip on the adjustable test clubs is currently adjustable by insertion and removal of a short section of grip is attached to each shaft extension plug, as shown in FIGS. 1 and 2. A new system of full length, removable grips in varying sizes and weights is being developed to provide improved club balance and feel to promote even more accurate test results. This will allow the fitter to not only set up a test club with the proper dead weight, balance, shaft flex, and length, but also the proper grip size in the actual weight category recommended, resulting in very exacting specifications for the club which is to be tested. Two, as a main priority in the development of this fitting system was to keep it very user friendly as compared to those systems found in the prior art, simplification of procedures is an ongoing concern. As an element of this ongoing process, a swing weight scale is being finalized which will allow the fitter to compare the balance of over or under length clubs to the balance (feel) of a standard length club with traditional lorythmic swing weight readings taken directly from the scale (i.e. as shown in the accompanying charts in Appendix "A"). No chart conversions would be necessary to determine, for example how a one inch over length club would feel in balance compared to a standard length club, which will further streamline the golf club fitting system of the present invention.

It is to be understood that numerous modifications, additions and substitutions may be made to the present invention which fall within the intended broad scope of the above disclosure. For example, although the steps of the present invention have been described with some particularity, the order and specific tests performed may be modified so long as the necessary information to enable proper functioning of the golf club fitting system of the present invention is retrieved by appropriate means. Also, the precise size, shape and dimensions of the elements of the present invention, including the fitting display plate and the adjustable lie board, may be modified or changed so long as the intended functionality of the present invention is not modified or destroyed. Finally, the precise figures and calculations used during use of the golf club fitting system of the present invention are critical to the present invention only so far as they permit interpretation of raw data taken from the player to connect the player to the right equipment for him or her to use, thus improving his or her game and thus their enjoyment. It is a key feature of the present invention that the golf club fitting system is designed to adapt to the player's and the fitter's needs and not force adaptation by the player and fitter to the system. This degree of flexibility and ability of the system to adapt to those changing needs sets the present invention apart from those fitting systems found in the prior art.

There has therefore been shown and described a golf club fitting system which accomplishes at least all of its intended purposes.

We claim:

1. An improved golf club fitting method for fitting a set of golf clubs to a player comprising the steps:

measuring a player's physical dimensions at least including grip strength of the player's hand;

selecting a representative golf club having a specific dead weight based on the measured grip strength of the player's hand, said dead weight being directly proportional to the player's grip strength, specifically that the dead weight of the golf club is greater when the player's grip strength is greater and vice versa;

recording the club length of the representative golf club;

determining the swing weight of the representative golf club;

computing a balance index (BI) for the representative golf club by dividing the dead weight (DW) by the numerical value of the swing weight (SW) (DW/SW=BI);

using said balance index (BI) determined for the representative golf club to determine alternatively the head heavy and head light deviation for the representative golf club; and generally corresponding balance index and dead weight values determined for said representative golf club to at least some of the other golf clubs in a set of golf clubs such that the system user can generally match different iron and wood golf clubs to the representative golf club thereby creating a generally ideal matched set of golf clubs for the player.

2. The improved golf club fitting method of claim 1 further comprising the step of conducting a player profile interview with a player to collect player information at least including physical limitations, right/left hand player, current playing ability, player's interpretation of their game and the player's goals for their game and the fitting session.

3. The improved golf club fitting method of claim 1 wherein said step of measuring a player's physical dimensions further comprises measuring at least the player's middle finger length, palm-to-wrist crease length, grip strength, player's height, ground to palm distance and ground to knuckle of player's longest finger.

4. The improved golf club fitting method of claim 1 further comprising the step of determining the preferred club head and club shaft configuration for the player at least factoring recommended shaft length taken from applicable fitting chart, shaft material options available, adjustments due to player flexibility, swing tempo, and shaft loading effects and additional grip weight due to size recommendations.

5. The improved golf club fitting method of claim 4 wherein the shaft length and the head weight of said test golf club is adjustable via a plurality of shaft extensions which are designed to releasably connect to the top end of the test golf club and are made in a series of progressively lengthened units such as the one-inch extension and the one and one-half inch extension, said head weights adapted to be releasably mounted into the club head of the test golf club, said head weights being in progressively heavier units such as the ¼ ounce weight and the ½ ounce weight such that the precise weight and shaft length for said test golf club can be set so that the player and fitter can determine the best fitting club for the player by finding the best fit shaft length and dead weight for the best fitting club and use the resulting balance index and dead weight figures to fit the rest of the desired set.

6. The improved golf club fitting method of claim 5 further comprising the steps of placing marking tape on the sole of the club head of said representative golf club, having the player hit at least one shot off of said lie plate of said adjustable lie board, recording the position of the impact mark on said marking tape via said hitting of at least one shot, adjusting the angle of said lie plate relative to said base to bring the angle of said lie plate into general alignment with the angle of the player's swing and repeating said hitting, recording and adjusting steps until the impact mark on said marking tape is generally centered on the club sole in relation to the heel and toe of the club head of said representative golf club.

7. The improved golf club fitting method of claim 1 wherein said step of selecting a representative golf club comprises selecting a test golf club having a determined dead weight, swing weight and balance, said determined dead weight, swing weight and balance calculated via said determining step, said test golf club having a club head including adjustable weighting means and adjustable weight positioning means, said test golf club further having shaft length adjustment means such that the weight and balance of said club head of said test golf club and the length of said shaft of said test golf club are adjustable to fit the player's determined swing characteristics.

8. The improved golf club fitting method of claim 1 further comprising the step of providing an adjustable lie board including a base plate on which is pivotably mounted a lie plate which is angle and attitude adjustable relative to said base plate, an angle readout device mounted on said base plate adjacent said lie plate operative to permit reading of the angle of said lie plate relative to said base plate, said adjustable lie board enabling use of said representative golf club during the angle determination section of the fitting process, with angle changes being made via said adjustable lie board instead of through the use of multiple test clubs with slightly different club head angles.

9. An improved golf club fitting method for fitting a set of golf clubs to a player comprising the steps:

measuring a player's physical dimensions at least including grip strength of the player's hand;

selecting a representative golf club having a specific dead weight based on the measured grip strength of the player's hand; said dead weight being directly proportional to the player's grip strength, specifically that the dead weight of the golf club is greater when the player's grip strength is greater and vice versa;

recording the club length of the representative golf club;

determining the swing weight of the representative golf club;

computing a balance index (BI) for the representative golf club by dividing the dead weight (DW) by the numerical value of the swing weight (SW) (DW/SW=BI);

using said balance index (BI) determined for the representative golf club to determine alternatively the head heavy and head light deviation for the representative golf club; and generally corresponding balance index and dead weight values determined for said representative golf club to at least some of the other golf clubs in a set of golf clubs such that the system user can generally match different iron and wood golf clubs to the representative golf club thereby creating a generally ideal matched set of golf clubs for the player;

providing an adjustable lie board including a base plate on which is pivotably mounted a lie plate which is angle and attitude adjustable relative to said base plate, an angle readout device mounted on said base plate adjacent said lie plate operative to permit reading of the angle of said lie plate relative to said base plate, said adjustable lie board enabling use of said representative golf club during the angle determination section of the fitting process, with angle changes being made via said adjustable lie board instead of through the use of multiple test clubs with slightly different club head angles;

placing marking tape on the sole of the club head of said representative golf club;

having the player hit at least one shot off of said lie plate of said adjustable lie board;

recording the position of the impact mark on said marking tape via said hitting of at least one shot;

adjusting the angle of said lie plate relative to said base to bring the angle of said lie plate into general alignment with the angle of the player's swing; and repeating said hitting, recording and adjusting steps until the impact mark on said marking tape is generally centered on the club sole in relation to the heel and toe of the club head of said representative golf club.

10. An improved golf club fitting system for fitting a set of golf clubs to a player comprising the steps:

measuring a player's physical dimensions at least including grip strength of the player's hand;

selecting a representative golf club having a specific dead weight based on the measured grip strength of the player's hand; said dead weight being directly proportional to the player's grip strength, specifically that the dead weight of the golf club is greater when the player's grip strength is greater and vice versa, said representative golf club comprising a test golf club having a determined dead weight, swing weight and balance, said determined dead weight, swing weight and balance calculated via said determining step, said test golf club having a club head including adjustable weighting means and adjustable weight positioning means, said test golf club further having shaft length adjustment means such that the weight and balance of said club head of said test golf club and the length of said shaft of said test golf club are adjustable to fit the player's determined swing characteristics;

providing a plurality of shaft extensions and a plurality of head weights for said test golf club, said plurality of shaft extensions adapted to releasably connect to the top end of the test golf club and which are made in a series of progressively lengthened units such as the one-inch extension and the one and one-half inch extension, said head weights adapted to be releasably mounted into the club head of the test golf club, said head weights being in progressively heavier units such as the ¼ ounce weight and the ½ ounce weight such that the precise weight and shaft length for said test golf club can be set so that the player and fitter can determine the best fitting club for the player by finding the best fit shaft length and dead weight for the best fitting club and use the resulting balance index and dead weight figures to fit the rest of the desired set;

computing a balance index (BI) for the representative golf club by dividing the dead weight (DW) by the numerical value of the swing weight (SW) (DW/SW=BI); and using said balance index (BI) determined for the representative golf club to determine alternatively the head heavy and head light deviation for the representative golf club; and generally corresponding balance index and dead weight values determined for said representative golf club to at least some of the other golf clubs in a set of golf clubs such that the system user can generally match different iron and wood golf clubs to the representative golf club thereby creating a generally ideal matched set of golf clubs for the player.

* * * * *